US005167973A

United States Patent [19]

Snyder

[11] Patent Number: 5,167,973

[45] Date of Patent: Dec. 1, 1992

[54] COMESTIBLES CONTAINER

[76] Inventor: William D. Snyder, 151 NE. 173rd. St., North Miami, Fla. 33162

[21] Appl. No.: 567,060

[22] Filed: Aug. 14, 1990

[51] Int. Cl.[5] ..... B65D 23/04

[52] U.S. Cl. ..... 426/115; 428/34.1; 426/112; 426/120; 426/124; 220/501; 206/222

[58] Field of Search ..... 426/106, 112, 113, 114, 426/120, 124, 115; 206/222; 220/501, 507; 428/34.1

[56] References Cited

U.S. PATENT DOCUMENTS

| | | | |
|---|---|---|---|
| 2,207,417 | 7/1940 | Smith | 220/501 |
| 4,013,798 | 3/1977 | Goltsos | 220/501 |
| 4,287,247 | 9/1981 | Reil et al. | 428/129 |
| 4,294,431 | 10/1981 | Levin et al. | 220/501 |
| 4,574,174 | 3/1986 | McGonigle | 426/113 |

*Primary Examiner*—Ellis P. Robinson
*Assistant Examiner*—Charles R. Nold
*Attorney, Agent, or Firm*—Malin, Haley, McHale, DiMaggio & Crosby

[57] ABSTRACT

The instant invention is a single unit providing both breakfast cereal, milk, and bowl including, in addition, means for mixing the milk with the cereal. The breakfast cereal is stored in a cereal cavity which later serves as the bowl. The milk is stored in a milk carton which is stored in a milk carton cavity. A spoon is preferentially also provided with the system so that everything the user needs to consume the breakfast cereal is provided. A trough is provided between the milk carton cavity and cereal cavity inclined downwardly from a position adjacent to and below the milk carton cavity toward the cereal cavity allowing milk leaving the milk carton to flow toward and enter the cereal cavity where it may mix with the cereal located therein. The aseptic packaging of the milk carton is provided with a frangible aperture located near the lowermost edge thereof and positioned adjacent to and above the trough leading into the cereal cavity when the milk carton is properly placed within the milk carton cavity. Preferably, the spoon is provided with a piercing means on its handle adapted to pierce the frangible aperture thereby allowing milk within the milk carton to drain into the trough where it will subsequently enter the cereal cavity. This allows the user quickly and easily to remove milk from the milk carton for mixing with the cereal in the cereal cavity.

5 Claims, 2 Drawing Sheets

COMESTIBLES CONTAINER

BACKGROUND OF THE INVENTION

1. Field of the Invention

This invention relates to a device for packaging breakfast cereal and a milk carton together for storage and use and more particularly to a device which stores both the breakfast cereal and milk carton, provides a means for mixing the milk within the milk carton with the breakfast cereal, and becomes a bowl for the breakfast cereal.

2. Description of Related Art

Individual packages of breakfast cereal have long been available to consumers. These individual packages have the advantage of being compact and storable without refrigeration. The contents of an individual package of breakfast cereal may be dispensed into a bowl whereafter refrigerated milk is added. Therefore, in addition to the package of breakfast cereal, a bowl and chilled milk are required to consume the contents of the package. With the advent of individual cereal containers having perforated front panels adapted to be opened, leaving the contents of the package therewithin, and to receive milk therein, at least the need for a bowl was dispensed with. However, milk to be mixed with the cereal has heretofore been available only from a separate, refrigerated supply. Because the respective shelf lives of milk and dry cereal have heretofore been of vastly different duration, it has not been possible to provide a compact, single-use breakfast cereal kit which included both a cereal and a fresh milk supply therein capable of being stored at room temperature for a substantial period of time.

Until recently, containers of milk were required to be refrigerated in order to prevent the spoiling of the milk. However, the development of UHT field containers has allowed containers of milk to be stored on a shelf for significant lengths of time without the need for refrigeration.

In today s two-worker families, the necessity of convenience in preparing meals is utmost. It is, therefore, desired to provide a self-contained breakfast-meal package that is compact and simple to prepare for consumption.

SUMMARY OF THE INVENTION

Described herein is a package for storing individual servings of breakfast cereal, which subsequently serves as a bowl for eating the cereal, which also serves as housing for a container of milk prepared under the UHT treatment and aseptically packed. The UHT treatment and aseptic packing provides milk with the same nutritional value as pasteurized milk but allows the milk to have a shelf life without refrigeration of at least several weeks, which coincides with the shelf life of most breakfast cereal so that the assembled package is able to be stored several weeks without refrigeration while retaining its nutritional value.

The instant invention is a single unit providing both breakfast cereal, milk, and bowl including, in addition, means for mixing the milk with the cereal. The breakfast cereal is stored in a cereal cavity which later serves as the bowl. The milk is stored in a milk carton which is stored in a milk carton cavity positioned adjacent the cereal cavity. A spoon is preferably also provided with the system so that everything the user needs to consume the breakfast cereal is provided.

A trough is provided between the milk carton cavity and cereal cavity inclined downwardly from a position adjacent to and below the milk carton cavity toward the cereal cavity allowing milk leaving the milk carton to flow toward and enter the cereal cavity where it may mix with the cereal located therein.

The aseptic packaging of the milk carton is provided with a frangible aperture located near the lowermost edge thereof and positioned adjacent to and above the trough leading into the cereal cavity when the milk carton is properly placed within the milk carton cavity.

Preferably, the spoon is provided with a piercing means on its handle adapted to pierce the frangible aperture thereby allowing milk within the milk carton to drain into the trough where it will subsequently enter the cereal cavity. This allows the user quickly and easily to remove milk from the milk carton for mixing with the cereal in the cereal cavity.

Various other arrangements for draining the milk from the milk container may be substituted for said frangible aperture.

It is therefore an object of the instant invention to provide a breakfast kit containing all the elements needed for eating a breakfast of dry cereal with milk added.

It is a further object of the invention to provide a selfcontained breakfast cereal and milk container that is capable of compact and non-refrigerated storage, yet allows for quick and convenient preparation for consumption.

It is still a further object of the invention to provide a storage container and cereal bowl in combination with a housing for a specially packaged supply of milk capable of sustaining a substantial non-refrigerated shelf-life without spoiling.

In view of these and other objectives which will become apparent in light of the disclosure herein, the principals of the invention will now be described in detail with like elements referred to by like numerals.

DETAILED DESCRIPTION OF THE INVENTION

Figure 1:
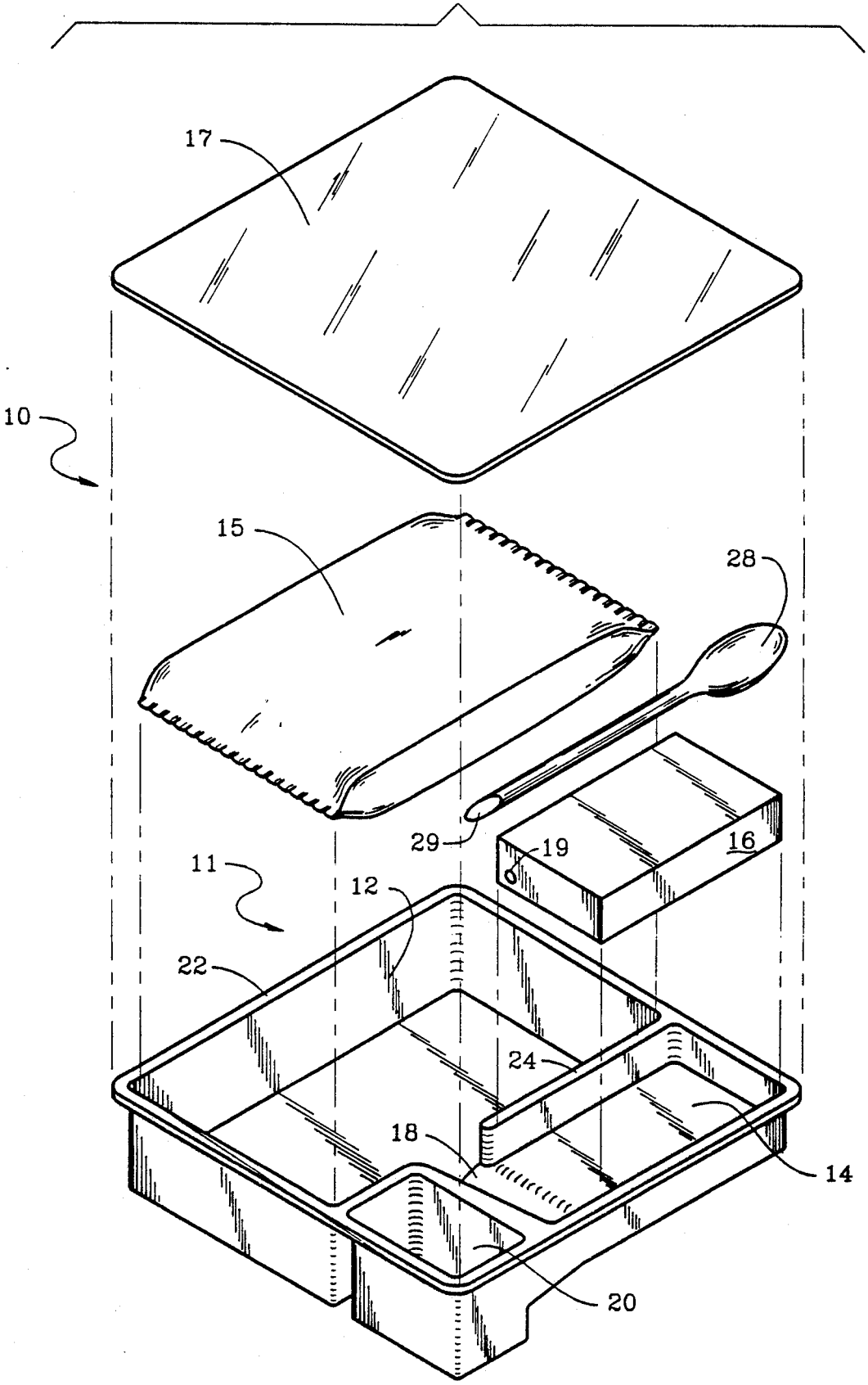
FIG. 1 is an exploded perspective view of the breakfast cereal kit of the instant invention.
Figure 2:
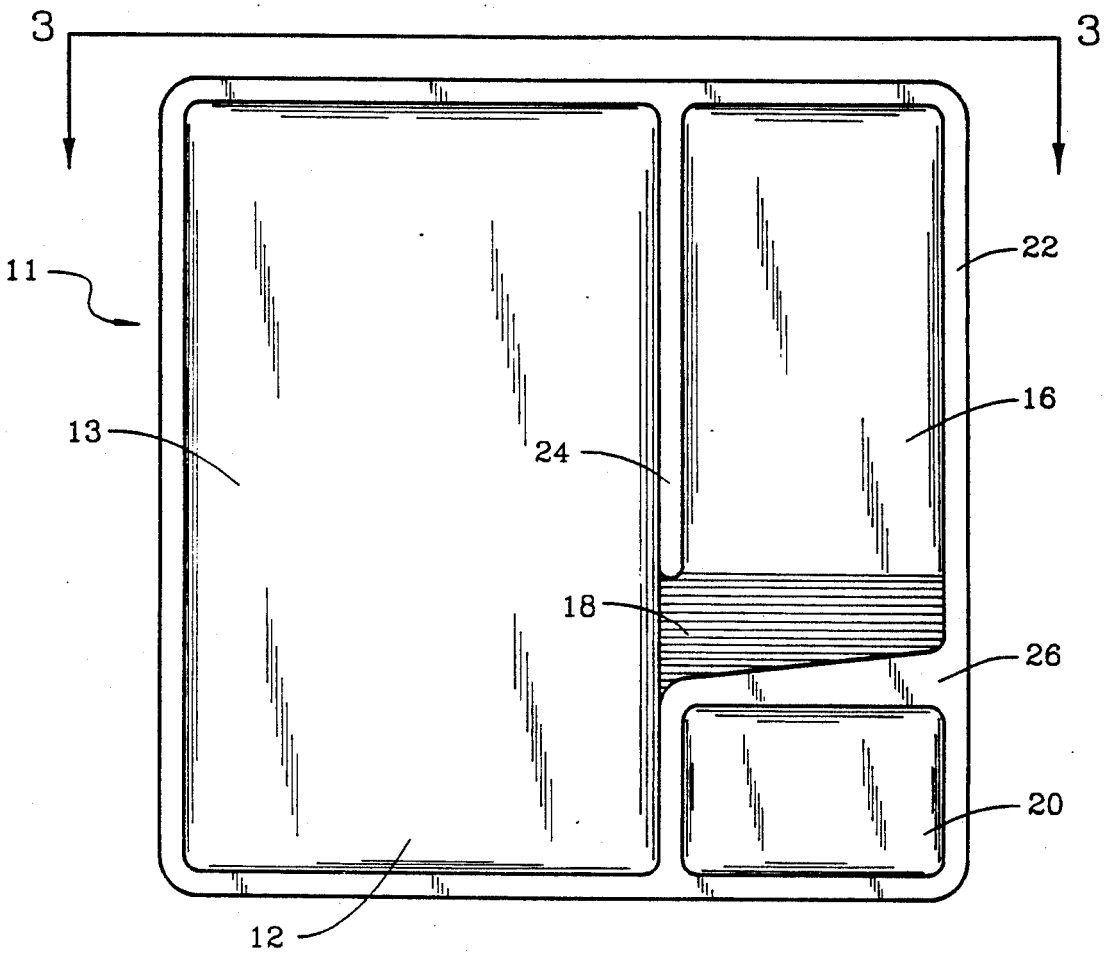
FIG. 2 is a plan view of the cereal and milk housing of the instant invention.
Figure 3:
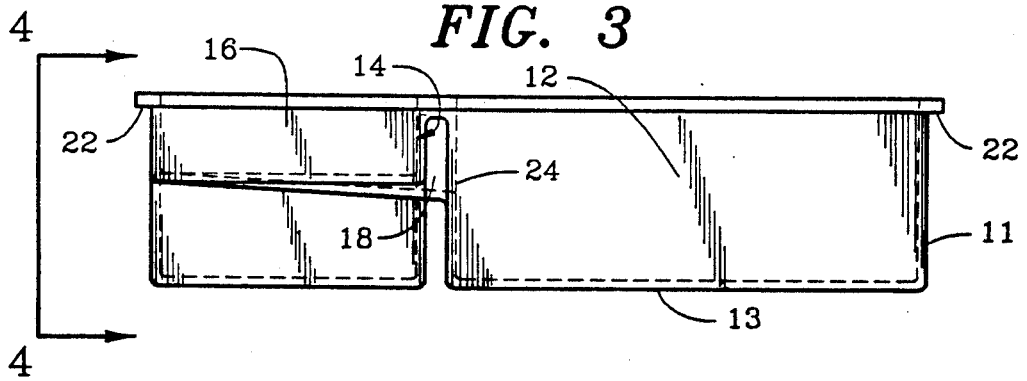
FIG. 3 is a rear elevational view of the housing of FIG. 2.
Figure 4:
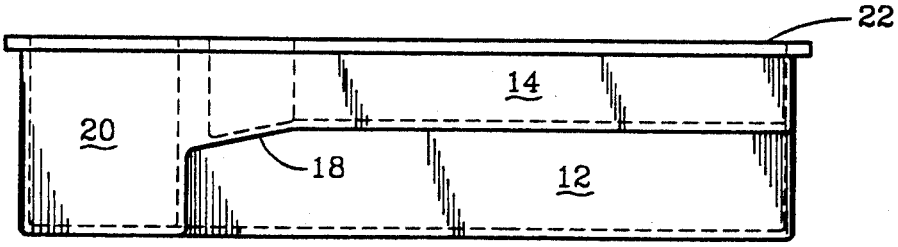
FIG. 4 is a left side elevational view of the housing of FIG. 2.

FIG. 1 shows the breakfast cereal kit of the instant invention designated generally by the reference numeral 10. The kit is comprised of a housing 11, a comestible package 15 such as dry cereal adapted to be placed within cereal cavity 12, a milk package 16 adapted to be received by a milk carton cavity 14, and in an alternative embodiment, a condiment cavity 20. Housing 11 is preferably provided with a sealing cover means 17 which is adapted to be sealingly connected to housing 11 about housing shoulder or ledge 22.

Housing defines a cereal cavity 12 preferably coextensive with the height and width of the housing 11 and extends along a substantial portion of the length. Dry breakfast cereal is stored within cereal cavity 12 during manufacture and until consumed. The dry cereal may be loosely packed in cereal cavity 12 or be contained within a cardboard box or a wax paper container 15 such as those in common use for individual portions of dry breakfast cereal. It is to be appreciated that cover 17 should be hermetically sealed to shoulder 22 and housing 11 be fabricated of an impervious material compatible with and capable of storing dry cereal for a substantial duration, particularly if said dry cereal is not prepackaged in packaging 15. The cardboard box or wax paper container 15 is then placed within cereal cavity 12 so that the dry cereal is disposed within cereal cavity 12. If the dry cereal is stored within this type of secondary container, the user must first remove the cereal from the container by, for example, tearing the wax paper or cardboard, and pouring the cereal into cereal cavity 12 before consuming the cereal.

Housing 11 further defines a milk package cavity 14 separated from cereal cavity 12 by dividing wall 24. Cavity 14 is preferably sized to hold a UHT treated aseptic packed milk carton 16. Cavity 14 houses a milk carton 16, such as that sold by Tetra Pak under U.S. Pat. No. 4,287,247, and referred to as a "brick". In the preferred embodiment, milk brick 16 is a standard 4.2 oz. size, but of course may be provided in other volumes as well. Milk brick 16 has a frangible aperture 19 defined one of its side walls 25 adjacent a drainage trough 18 which fluidly communicates cavity 16 with cavity 12 when said brick 14 is properly positioned within housing 11. Aperture 19 may be punctured at the time milk within milk carton 16 is to be mixed with the dry cereal in cereal cavity 12. Said aperture 19 may be opened by any other convenient method, such as by a tear-away tab (not shown).

The frangible aperture 19 may preferably be punctured by a nub 29 on the end of spoon 28 which is provided with the kit 10 as shown in FIG. 1. After puncturing the frangible aperture 19, milk within milk carton 16 flows under the force of gravity out of milk carton 16 into inclined trough 18. Trough 18 connects milk carton cavity 14 and cereal cavity 12 and is angled downward so that milk flowing out of milk carton 16 into trough 18 will continue under the force of gravity into cereal cavity 12. Because the floor 23, of milk carton cavity 14 is higher than floor 13, of cereal cavity 12, the milk within milk carton 16 will flow through frangible opening 19 into trough 18 and subsequently into cereal cavity 12.

Although a specific embodiment of spoon 28 showing the location of nub 29 is shown in FIG. 1, any means for puncturing frangible opening 19 is within the scope of the invention. These alternate means for puncturing frangible aperture 19 may include alternate locations of nub 29 on spoon 28 as well as means for puncturing frangible aperture 19 which are independent of spoon 28.

Condiment cavity 20 is provided to store appropriate condiments such as sugar, fruit or the like which may be mixed with the dry cereal in cereal cavity 12 as desired. Condiment cavity wall 26 separates condiment cavity 20 from milk carton cavity 14 and defines one side of condiment cavity 20 as well as one side wall of trough 18. Although the preferred embodiment of the invention includes condiment cavity 20, it is within the scope of the invention to exclude same or to include more than one such cavity 20 for various condiments and the like.

Shoulder 22 is adapted to support a cover 17 which is preferably, but not by way of limitation, sealingly placed across the upper surface of housing 11. Such a sealing material may be a clear plastic material or other material suitable to provide an impervious seal between the perishable cereal product and the ambient, both of which may be embossed with appropriate trade dress.

To use the instant invention, the entire package 10 or simply the milk brick 16 is refrigerated until the milk has been brought down to the desired temperature. Thereafter, cover 17 is removed from shoulder 22, if it has not already been removed, exposing the cereal within cavity 12 and milk brick 16, as well as a spoon 28. Condiment cavity 20 may be provided with a separate sealing condiment cover (not shown) placed over the top thereof. Access to condiment cavity 20 in such an embodiment therefore requires the removal of said condiment cover in addition to cover 17.

Frangible aperture 19 is punctured using nub 29 on spoon 28. Milk will thereafter flow under the force of gravity from milk carton 16 into trough 18 and subsequently into cereal cavity 12. There, the milk will mix with the cereal placed therein and the cereal consumed directly therefrom. If desired, condiment cavity 20 may be opened and whatever condiments contained therein may be mixed with the dry cereal to the user's liking.

In the preferred embodiment, housing is made from a plastic material in one piece by techniques such as stamping or injection molding as is well known in the art. In an alternate embodiment, housing 11 may be manufactured in one piece of a heavy paper type material by techniques common in the art.

When the cereal within cereal cavity 12 is consumed, the entire kit 10, including milk carton 16, spoon 28, cover 17, condiment cover and any secondary container for storing the dry cereal may then be quickly and easily disposed of in an appropriate trash receptacle. This eliminates the need for clean-up and facilitates the use of the instant invention by users with little time to engage in the time consuming ritual of breakfast preparation and clean-up.

It should be noted that an additional support element 30 may be employed, connected to the housing 11 near the underside of cavity 14, to provide a balanced stable base for kit 10.

Having thus described the instant invention in connection with the specific embodiments, it is emphasized that the description has been given by means of example only and not by means of limitation. It is clear that changes and modifications may be made to the description and still be within the scope of the invention. Further, obvious changes and modifications will occur to those skilled in the art.

Having thus described the instant invention, what is claimed is:

1. A combination breakfast cereal and fresh milk kit capable of being stored at room temperature for a substantial period of time, comprising:

a means for housing a single serving of said breakfast cereal in a breakfast cereal cavity defined by said means for housing, said breakfast cereal disposed within said means for housing, said means for housing further containing a UHT field container aseptically encompassing a single serving quantity of said fresh milk therein within a milk receptacle cavity defined by said means for housing spaced from said cereal cavity, a milk flow passageway defined by said means for housing and fluidly communicating said cereal cavity with said milk supply cavity, and means for covering said cereal cavity and said milk supply cavity from the ambient.

2. The combination breakfast cereal and fresh milk kit of claim 1, further comprising:

an eating utensil having a relatively sharp projection extending therefrom adapted to puncture a corresponding frangible flap integrally connected with a side wall of said UHT field container so as to fluidly communicate the interior of said container with the exterior thereof.

3. The combination breakfast cereal and fresh milk kit of claim 1, wherein said single serving of breakfast cereal is prepackaged in a storage means.

4. The combination breakfast cereal and fresh milk kit of claim 2, further comprising a condiment cavity defined by said means for housing adapted to store condiments to be consumed with said cereal.

5. A combination breakfast cereal and fresh milk kit capable of being stored at room temperature for a substantial period of time, comprising:

means for holding at least one serving of said breakfast cereal encompassing at least one serving of said breakfast;

a UHT field container aseptically encompassing at least one serving of said fresh milk therein;

a housing defining a breakfast cereal cavity and a milk receptacle cavity spaced from said breakfast cavity, said housing further defining a milk flow passageway, said milk flow passageway providing fluid communication between said breakfast cereal cavity and said milk receptacle cavity; and enclosure means for enclosing said means for holding and said UHT field container.

* * * * *